US006572333B2

(12) United States Patent
Fujinaka

(10) Patent No.: US 6,572,333 B2
(45) Date of Patent: Jun. 3, 2003

(54) AIR BLOWER

(75) Inventor: Hiroyasu Fujinaka, Moriguchi (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/005,157

(22) Filed: Dec. 7, 2001

(65) Prior Publication Data

US 2002/0076323 A1 Jun. 20, 2002

(30) Foreign Application Priority Data

Dec. 15, 2000 (JP) ..... 2000-381881

(51) Int. Cl.[7] ..... F04D 29/54

(52) U.S. Cl. ..... 415/208.2; 415/211.2; 415/22 D; 415/222

(58) Field of Search ..... 415/191, 208.2, 415/211.2, 220, 221, 222; 417/423.14

(56) References Cited

U.S. PATENT DOCUMENTS 3,700,358 A * 10/1972 Papst et al. ..... 417/354
4,221,546 A * 9/1980 Papst et al. ..... 417/354
4,564,335 A * 1/1986 Harmsen et al. ..... 415/213.1

FOREIGN PATENT DOCUMENTS

JP 09264300 10/1997

* cited by examiner

*Primary Examiner*—Ninh H. Nguyen
(74) *Attorney, Agent, or Firm*—Parkhurst & Wendel, L.L.P.

(57) ABSTRACT

It is an object of the present invention to improve energy efficiency of an air blower. An annular wall is formed to extend from a suction-side end of a housing body toward a discharge side of a blade tip of a fan so as to provide an air pocket between the housing body and the annular wall. Improvements are made to joint ends of spokes to the annular wall adjacent the air pocket, or to inclination directions of the spokes, thereby improving performance of the air blower or thinning the air blower.

9 Claims, 11 Drawing Sheets

AIR BLOWER

FIELD OF INVENTION

The present invention relates to an air blower used for office automation equipment (OA), an audio-visual equipment (AV), and the like.

BACKGROUND OF THE INVENTION

With recent miniaturization and electronization tendency of equipments, a high density electronic circuit has been frequently used in OA and AV equipments and the like. With this tendency, exothermic density of electronic equipment is also increased, and thus an air blower is used for cooling the equipment.

As the progress of miniaturization of such equipment, it is required to reduce the air blower used for the equipment in size and thickness.

At the same time, it is strongly required to reduce a noise of the air blower that is one main factor of a noise generated by the equipment.

As shown in FIG. 13, a conventional air blower is formed with an annular wall 2 spaced from a blade tip of a fan 1, and in an air-blowing state in which a motor 3 is energized, the axial fans 1 rotate around an axis 4, so that an air flow 5 is generated to flow from a suction side toward a discharge side.

In the above-described air-blowing state, however, a speed of the air flow 5 on a back pressure side of the blade tip becomes faster, and an inter-blade secondary flow causes a low energy region to be generated on a rear edge side of the blade tip where the air flow is converted into pressure energy. This portion poses problems that energy loss is great and the flow is prone to be separated, that the air flow 5 is deviated from a blade surface, and that a vortex flow is generated in this deviated region, thereby increasing a turbulent flow noise and deteriorating a noise level and capacity/static pressure characteristics.

This phenomenon is frequently found when an air blower is used under a condition where there is a large pressure difference between the suction side and the discharge side, and leaking vortex generated at the blade tip increases, presenting a state that the fan loses speed.

The present invention is accomplished in view of the above problems, and it is an object of the invention to suppress the energy loss at the time of blowing air to improve the noise level and capacity/static pressure characteristics, and to reduce the air blower in size and thickness.

SUMMARY OF THE INVENTION

In an air blower of the present invention, a housing body for accommodating a fan is provided with an annular wall to form an air pocket while a shape of a spoke integrally formed with the housing body is devised.

According to this invention, it is possible to suppress energy loss at the time of blowing air, to lower a noise, and to reduce the air blower in size and thickness.

A first aspect of the present invention provides an air blower, which has a fan, a housing body accommodating the fan, an annular wall formed inside the housing body and spaced from a blade tip of the fan, a boss to be attached with a motor for driving the fan, and spokes connecting the boss and the annular wall, characterized in that air pockets are provided between the housing body and the annular wall, each air pocket having a given volume and being opened toward a discharge side of an air flow generated by rotation of the fan, and joint ends of the spokes on the annular wall side adjacent the air pockets are respectively positioned on a downstream side, provided that each air pocket is divided into an upstream side and the downstream side along the air flow in a rotational direction of the fan. Whereby, interference between the spokes and the air pockets can be reduced to exert best effects thereof, energy loss at the time of blowing air can be suppressed, and a noise can be reduced.

A second aspect of the present invention provides an air blower, which has a fan, a housing body accommodating the fan, an annular wall formed inside the housing body and spaced from a blade tip of the fan, a boss to be attached with a motor for driving the fan, and a spoke connecting the boss and the annular wall, characterized in that air pockets are provided between the housing body and the annular wall, each air pocket having a given volume and being opened toward a discharge side of an air flow generated by rotation of the fan, the annular wall-side spokes disposed adjacent the air pockets are placed to be inclined in a direction opposite to a rotational direction of the fan with respect to a radial direction as viewed from a rotational center of the fan, and the spokes and the rotatative fan gradually intersect with each other from a rear edge of the blade tip of the fan. Whereby, the interference between the fan and the spokes can be moderated to suppress pressure variation so as to realize improvement of the air blowing performance and reduction of the noise. Further, since the clearance between the spokes and the fan can be reduced, it is possible to realize a thin air blower which is small in its axial direction.

A third aspect of the present invention provides an air blower, which has a fan, a housing body accommodating the fan, an annular wall formed inside the housing body and spaced from a blade tip of the fan, a boss to be attached with a motor for driving the fan, and spokes connecting the boss and the annular wall, characterized in that air pockets are provided between the housing body and the annular wall, each air pocket having a given volume and being opened toward a discharge side of an air flow generated by rotation of the fan and joint ends of the spokes on the annular wall side adjacent the air pockets are respectively positioned on a downstream side, provided that each air pocket is divided into an upstream side and the downstream side along the air flow in a rotational direction of the fan, the spokes are placed to be inclined in a direction opposite to a rotational direction of the fan with respect to a radial direction as viewed from a rotational center of the fan, and the spokes and the rotatative fan gradually intersect with each other from rear edge of the blade tip of the fan. Whereby, the noise at the time of blowing air is further prevented from being generated, allowing further reduction of the noise, and a small and thin air blower can be realized.

Further, an OA equipment or an AV equipment of the invention having the above-described air blower prevents a noise from being generated, and is small in size and thin in thickness, and can be preferably used in a place such as a personal room which requires an quiet environment, or in a place such as an office where there are a large number of equipments of the kind.

DESCRIPTION OF THE PREFERRED EMBODIMENT

An embodiment of the present invention will be described below with reference to FIGS. 1 to 12.

In an air blower according to the embodiment of the present invention, it is necessary to form an air pocket between a housing body and an annular wall, and to specifically define a spoke shape adjacent the air pocket.

First, the air pocket will be described using FIGS. 1 to 3.

Figure 1A:
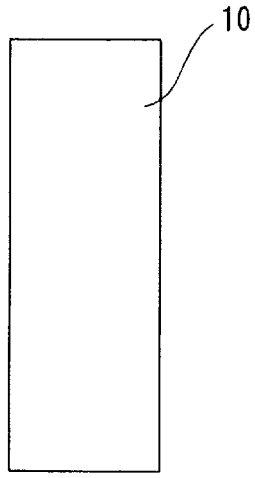
FIGS. 1*a*, 1*b*, 1*c* and 1*d* are respectively a side view, a front view, a sectional view and a sectional detailed view of an air blower in an embodiment of the present invention.
Figure 1B:
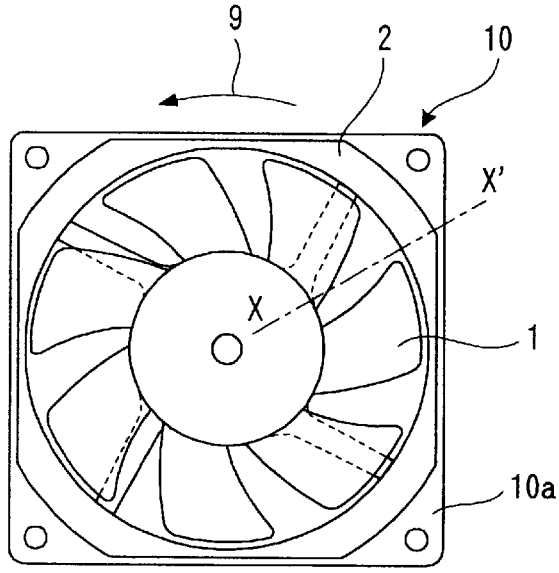
Figure 1C:
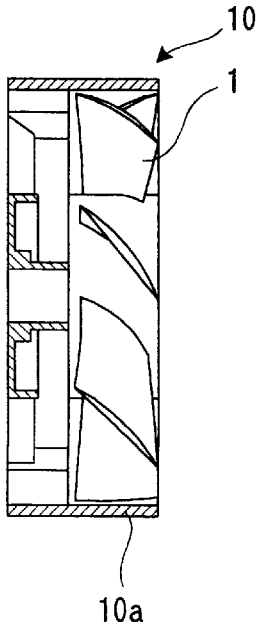
Figure 1D:
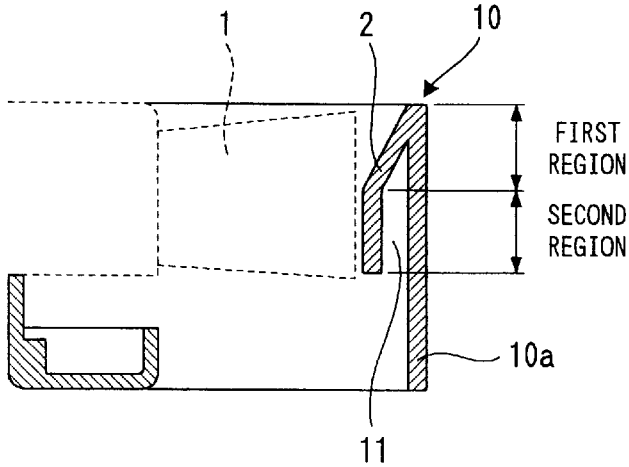
Figure 2:
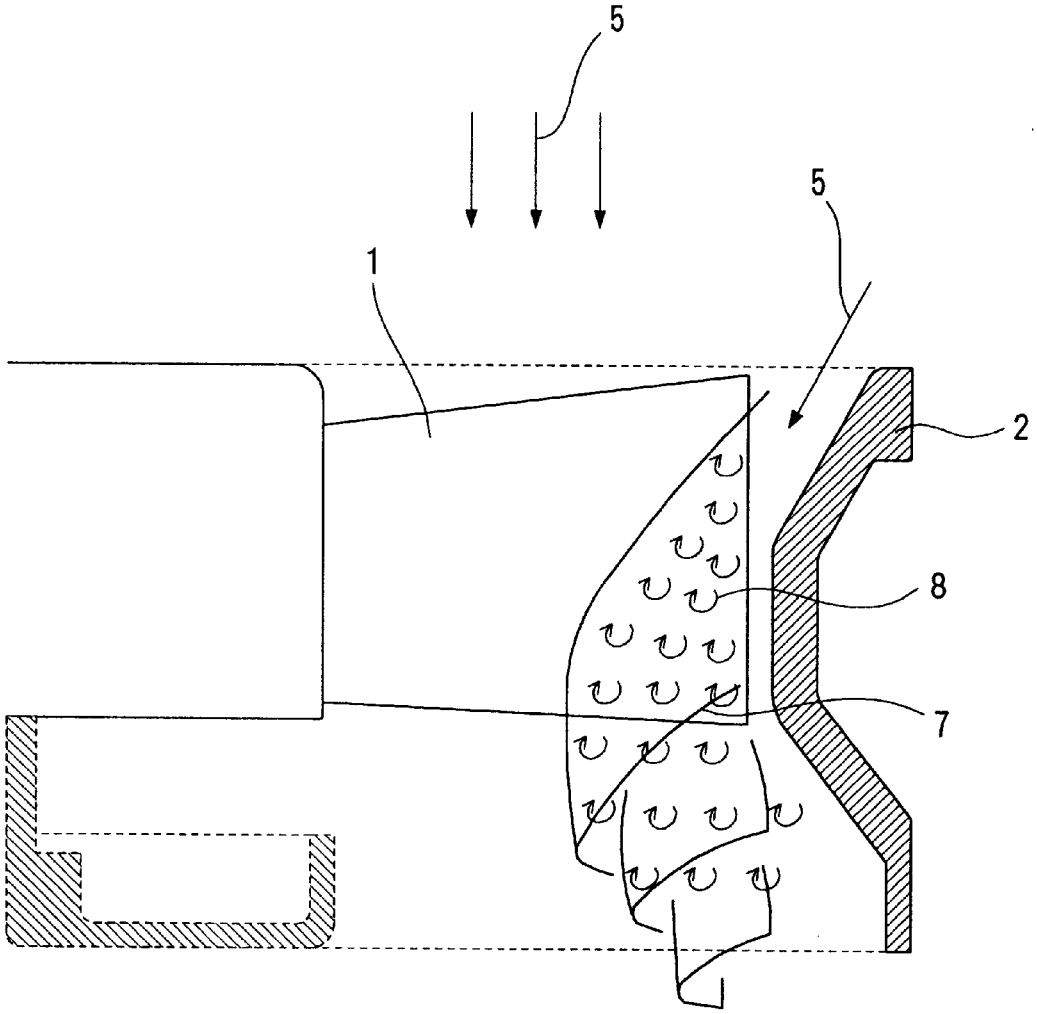
FIG. 2 PRIOR ART
FIG. 2 is an explanatory view showing an air flow in a conventional air blower.

FIGS. 1*a* to 1*d* show the air blower according to the embodiment of the present invention. FIG. 1*a* is a side view, FIG. 1*b* is a front view, FIG. 1*c* is a sectional view and FIG. 1*d* is a sectional detailed view taken along X–X' line.

The air blower includes a fan 1, which is driven to rotate by a motor, and a housing 10 for accommodating the fan 1, and is constituted to generate an air flow flowing from a suction side toward a discharge side by the rotation of the fan 1. A reference numeral 9 indicates a direction of the rotation.

The housing 10 is constituted by integrally forming a housing body 10*a*, an annular wall 2 formed inside the housing body 10*a* and spaced from a blade tip of the fan 1, a boss 16 for attaching the motor for driving the fan, and spokes 17 for connecting the boss 16 and the annular wall 2. Such a housing 10 is generally formed by fabrication using a thermoplastic resin.

As shown in FIG. 1*d*, the annular wall 2 is extended from an end of the suction side of the housing body 10*a* toward the blade tip of the fan 1, and is opened toward the discharge side. An air pocket 11 which has a given volume and is opened toward the discharge side is formed between the housing body 10*a* and the annular wall 2.

Reasons for providing the air pocket 11 will be described with reference to FIGS. 2 and 3.

In a conventional air blower, the air flow flowing from the suction side toward the discharge side is generated by the rotation of the fan, but there has been a problem that a noise is generated due to the energy loss as described above. Thus, a clearance between the blade tip of the fan 1 and the annular wall 2 is not uniform but the annular wall 2 is formed such that the clearance is widened on the suction side.

With such a structure, the air flow 5 generated by the rotation of the fan 1 is less influenced by viscosity of air since the clearance is wider on the suction side of the blade tip, the air flow 5 is also drawn from the blade tip, which makes it possible to reduce the energy loss when air flows in, and to increase air capacity efficiently. This structure is especially advantageous when the pressure is low as compared with the case in which the clearance between the blade tip and the annular wall 2 is uniform.

However, if the clearance between the blade tip on the suction side and the annular wall 2 is widened, although the capacity can be increased at the time of low pressure, in the case that the air blower is used in a state in which pressure is applied to some extent, a leakage vortex 7 flowing from a positive pressure side toward a back pressure side largely grows at the blade tip. As a result, the air flow 5 is separated from the blade surface, a turbulent flow 8 is generated in thus separated region, which increases turbulent flow noise, and noise level and capacity/static pressure characteristics are deteriorated.

The blade tip leakage vortex 7 does not largely grows at the suction side of the blade tip, and the leakage vortex 7 largely grows from an intermediate portion of the blade tip on the contrary, which largely affects the performance of the fan 1.

Thus, in this embodiment, as shown in FIG. 1*d*, the annular wall 2 is constituted by a first region where the annular wall 2 is provided so as to substantially widen a clearance between the blade tip on the suction side and the annular wall 2, and a second region having a smaller clearance between the annular wall 2 and the blade tip, thereby to increase the air capacity in a low pressure state. In addition, the air pocket 11 is provided between the annular wall 2 and the housing body 10*a* to cancel the blade tip leakage vortex 7 which has largely grown from the intermediate portion of the blade tip.

Figure 3:
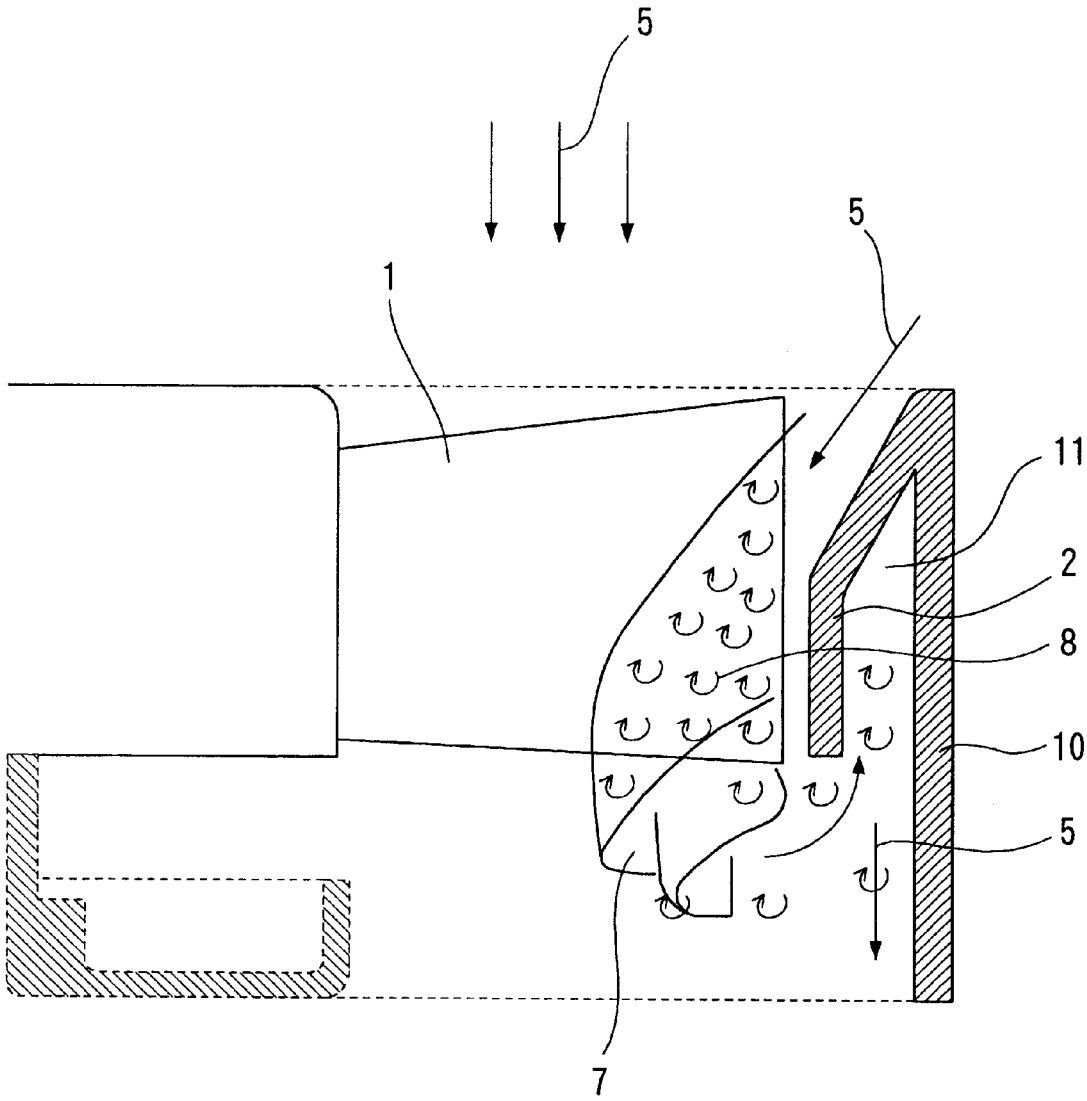
FIG. 3 is an explanatory view showing an air flow of an air blower in the embodiment of the present invention.

With such a structure, as shown in FIG. 3, the blade tip leakage vortex 7 which has largely grown from the intermediate portion of the blade tip is once drawn by the air pocket 11 on the discharge side of the fan 1, and the turbulent flow 8 generated therein is attenuated to some degree in the air pocket 11 and then is discharged toward the discharge side. Therefore, the noise level and capacity/static pressure characteristics (especially the noise level) can be enhanced.

Next, a shape of the spoke 17 will be described with reference to FIGS. 4 to 12.

With the recent progress of miniaturization and high density of equipments, there is a demand for smaller air blowers with increased air blowing ability. Since the air blowing ability of the fan 1 is generally proportional to areas of the fan 1, a method is taken to increase an outer diameter of the fan 1 as large as possible with respect to the housing 10.

However, when the outer diameter of the fan 1 is increased as large as possible, since the outer shape of the housing 10*a* is generally rectangular, it is difficult to form the air pocket 11 which is uniform over the entire circumference, so that the air pockets 11 are consequentially formed at each of four corners of the housing body 10*a*.

FIGS. 4 to 7 show the housing 10 in which the air pockets 11 are formed. In the drawings, the fan 1 is indicated by broken lines so that the shape and positional relation of the spoke 17 can easily be understood.

The housing 10 is constituted by integrally forming the housing body 10*a*, the annular wall 2, the boss 16 for attaching the motor for driving the fan, and the spoke 17 for connecting the boss 16 and the spoke 17, by using the thermoplastic resin as described above.

The spoke 17 is placed to be inclined to some degrees with respect to a radial direction of the fan 1 as viewed from a rotational center for the purpose of moderating the influence of contraction at the time of formation and the like. If a distance between the fan 1 and the spoke 17 is sufficiently secured, little influence is exerted on the characteristics of the air blower, but when the distance between the fan 1 and the spoke 17 becomes smaller to some extent, which exerts a large effect on the characteristics of the air blower, this tendency becomes remarkable if the spoke 17 is formed in the vicinity of the air pocket 11. Details thereof will be described below.

Figure 4A:
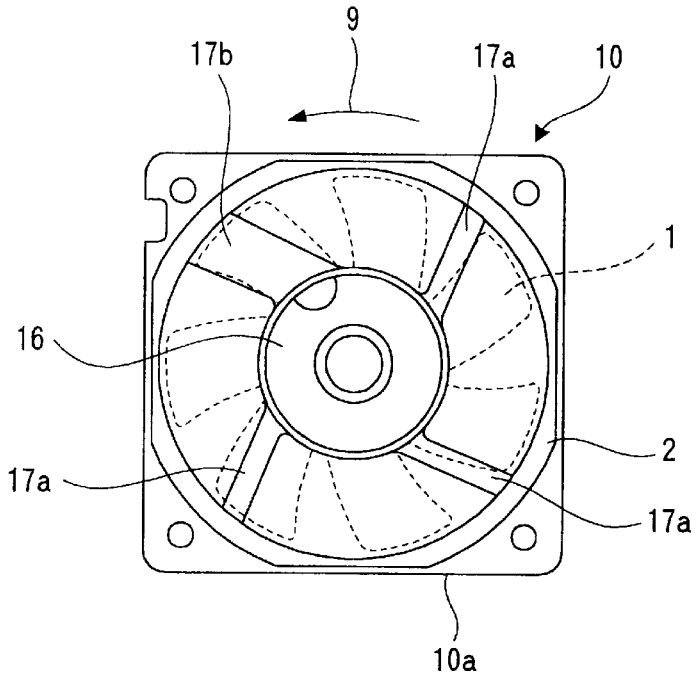
FIGS. 4*a* and 4*b* are respectively a front view and a rear view showing a first example of a housing shape in the embodiment of the present invention.
Figure 4B:
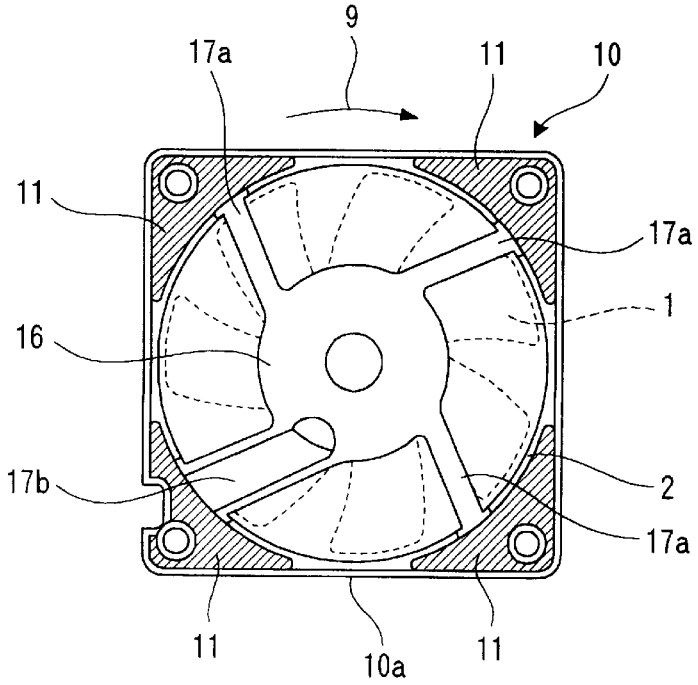

FIG. 4 shows a first example of the housing shape.

As shown in FIG. 4*a*, the spoke 17 formed in the housing 10 includes total four spokes, that is, three thin spokes 17*a* and one spoke 17*b* having a wider width for pulling out a lead wire of the motor. The four spokes 17*a* and 17*b* are equidistantly disposed along the circumferential direction.

Joint ends of the spokes 17*a* and 17*b* on the side of the annular wall 2 are slightly deviated into a rotational direction 9 of the fan 1 from a line connecting the rotational center of the fan 1 and a center of the air pocket 11. The spokes 17*a* and 17*b* are inclined toward the rotational direction 9 of the fan with respect to the radial direction as viewed from the rotational center of the fan 1.

Figure 5A:
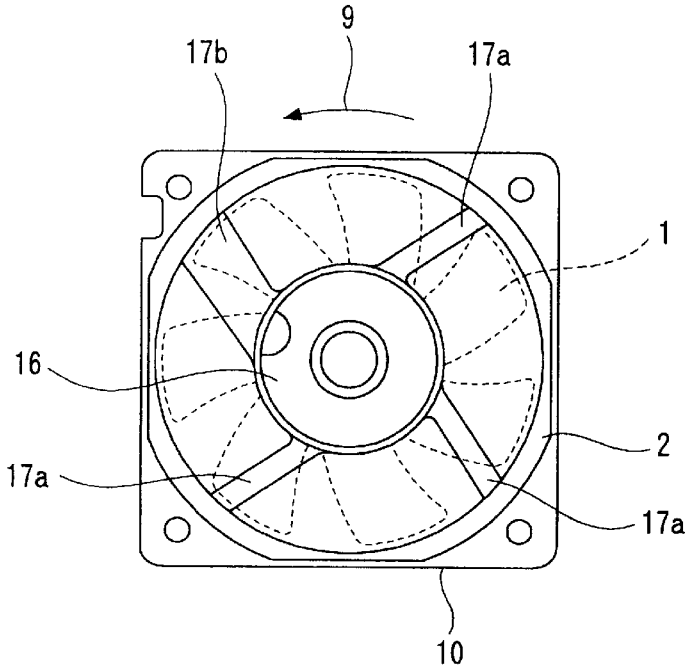
FIGS. 5*a* and 5*b* are respectively a front view and a rear view showing a second example of the housing shape in the embodiment of the present invention.
Figure 5B:
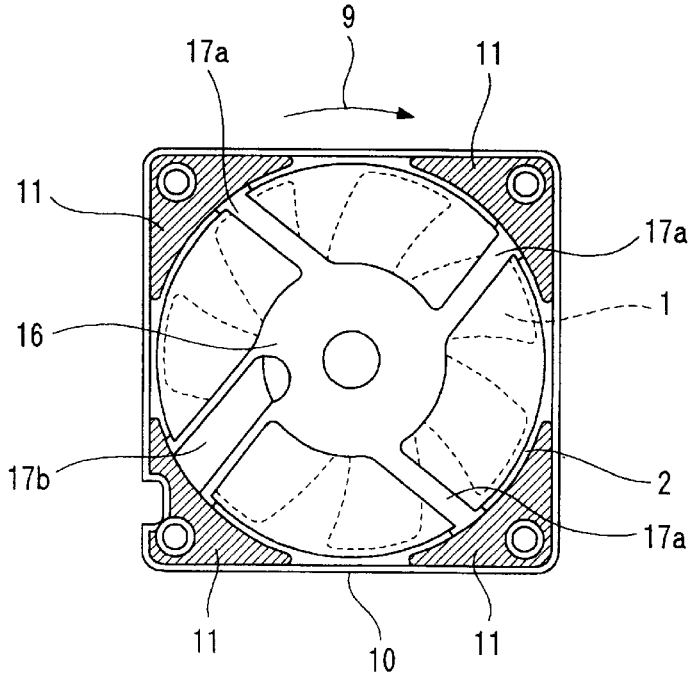

FIG. 5 shows a second example of the housing shape.

In a housing 10 formed in the same manner as that of FIG. 4, the joint ends of the spokes 17*a* and 17*b* on the side of the annular wall 2 are slightly deviated from a line connecting the rotational center of the fan 1 and the center of the air pocket 11 toward the rotational direction 9 of the fan 1. The spokes 17*a* and 17*b* are inclined opposite to the rotational direction 9 of the fan with respect to the radial direction as viewed from the rotational center of the fan 1.

Figure 6A:
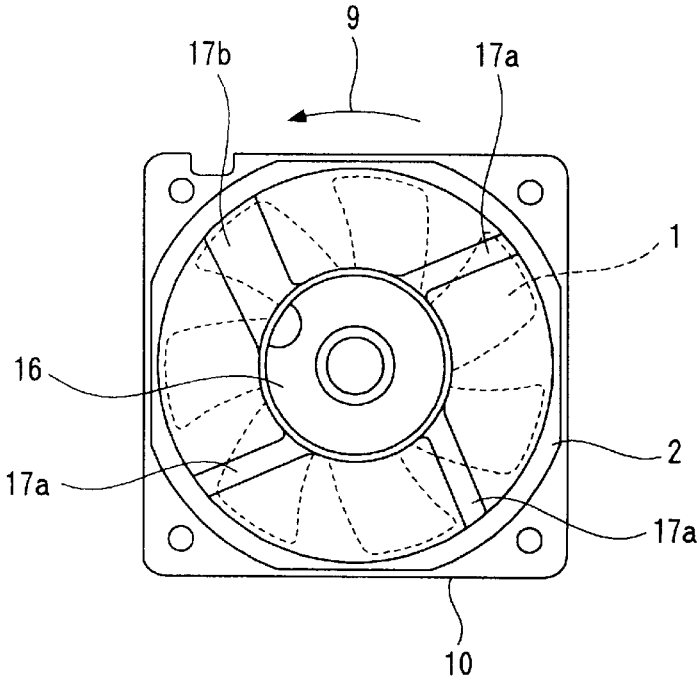
FIGS. 6*a* and 6*b* are respectively a front view and a rear view showing a third example of the housing shape in the embodiment of the present invention.
Figure 6B:
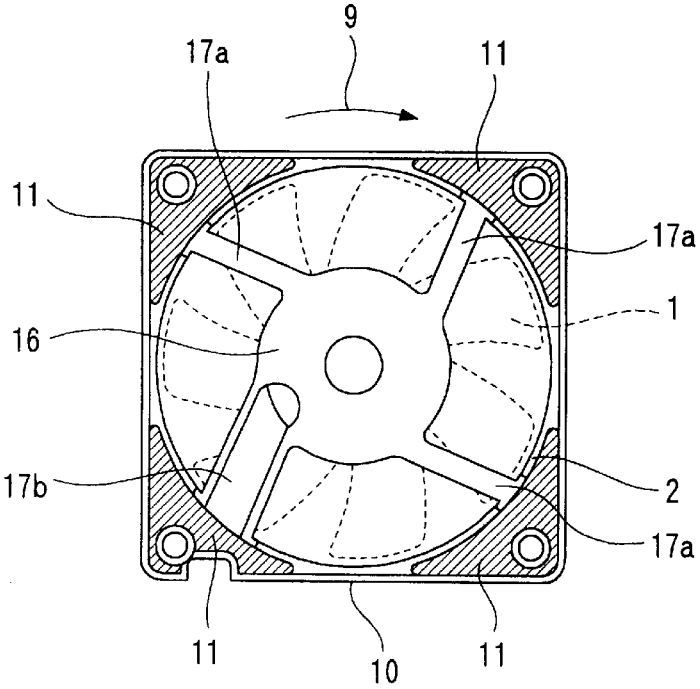

FIG. 6 shows a third example of the housing shape.

In this housing 10, the joint ends of the spokes 17*a* and 17*b* on the side of the annular wall 2 are slightly deviated from a line connecting the rotational center of the fan 1 and the center of the air pocket 11 in the opposite direction to the rotational direction 9 of the fan 1. The spokes 17*a* and 17*b* are inclined opposite to the rotational direction 9 of the fan with respect to the radial direction as viewed from the rotational center of the fan 1.

Figure 7A:
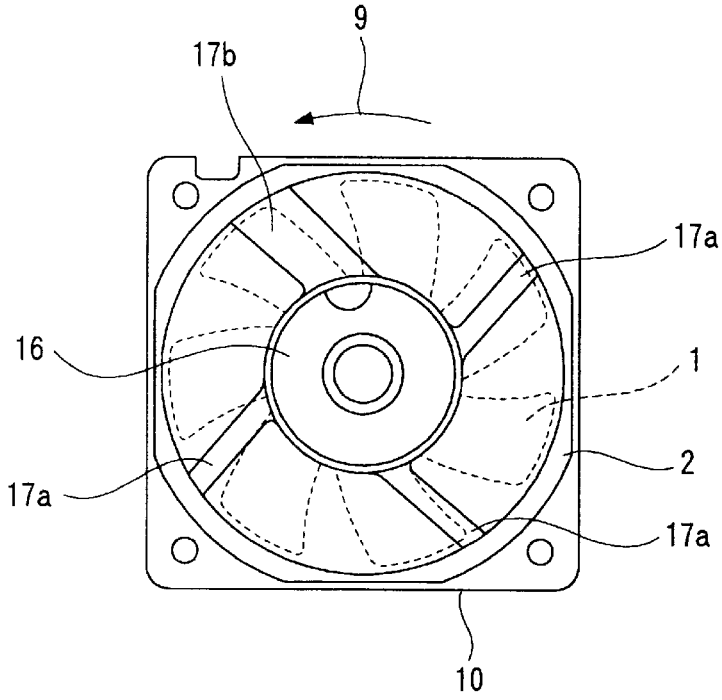
FIGS. 7*a* and 7*b* are respectively a front view and a rear view showing a fourth example of the housing shape in the embodiment of the present invention.
Figure 7B:
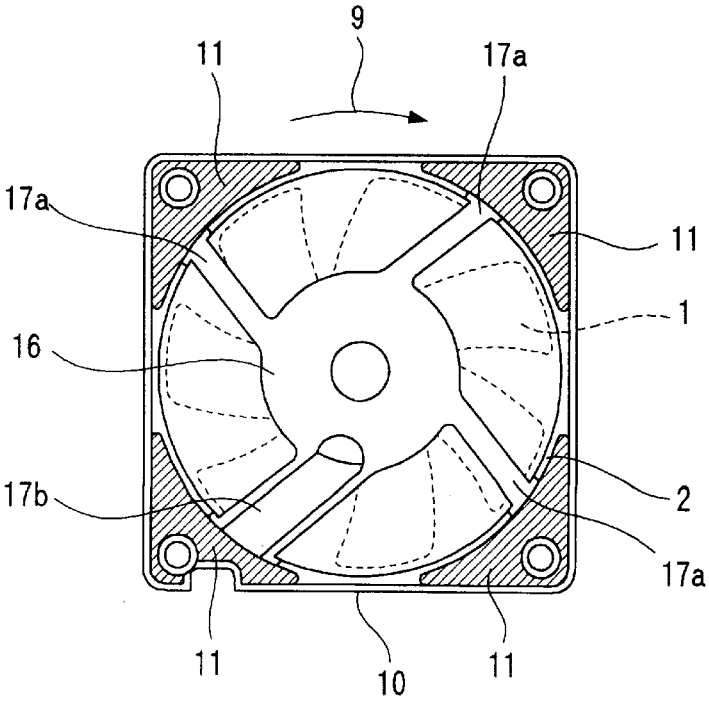

FIG. 7 shows a fourth example of the housing shape.

In this housing 10, the joint ends of the spokes 17*a* and 17*b* on the side of the annular wall 2 are slightly deviated from a line connecting the rotational center of the fan 1 and the center of the air pocket 11 in the opposite direction to the rotational direction 9 of the fan 1. The spokes 17*a* and 17*b* are inclined in the same direction as the rotational direction 9 of the fan with respect to the radial direction as viewed from the rotational center of the fan 1.

The performance of the air blower using these four housings 10 will be separately described for the joint ends of the spokes 17 on the side of the annular wall 2 and for the inclination of the spokes 17.

First, as shown in the first example (FIG. 4) and the second example (FIG. 5), concerning the connection positions of the spokes 17 on the side of the annular wall 2, if the joint ends are slightly deviated toward the rotational direction 9 of the fan 1 with respect to the center of the air pocket 11, superior characteristics are presented as compared with a case where the joint ends are slightly deviated in the opposite direction to the rotational direction 9 of the fan 1 with respect to the center of the air pocket 11. The reason is as follows.

Figure 8:
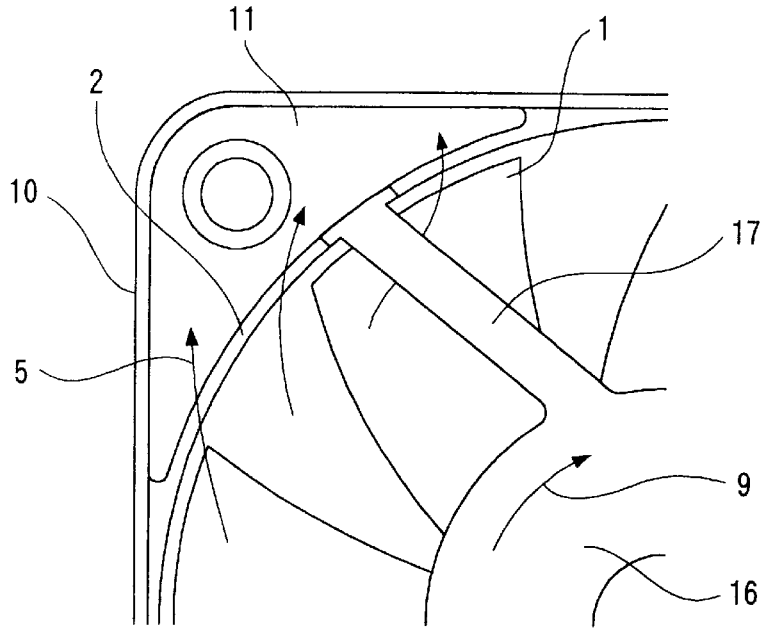
FIG. 8 is an explanatory view showing an air flow of the air blower having the housing shape of the second example of the present invention.
Figure 9:
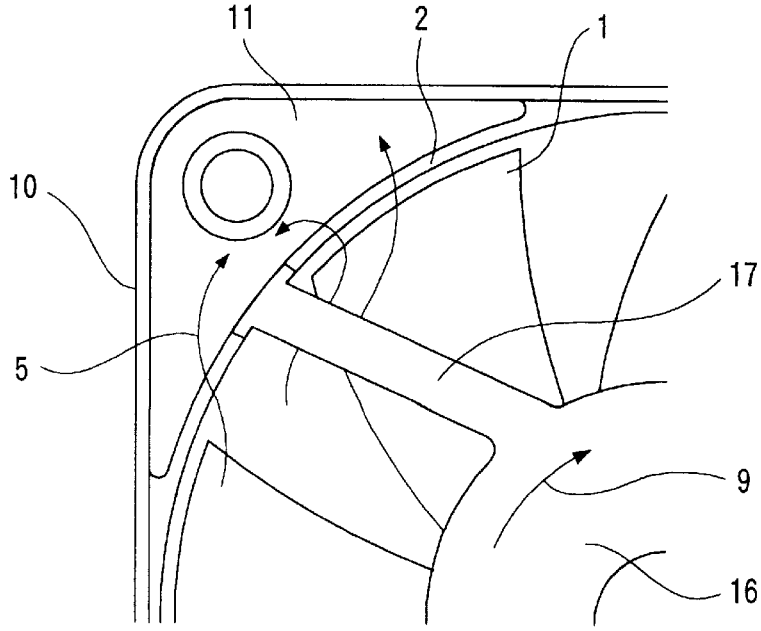
FIG. 9 is an explanatory view showing an air flow of the air blower having the housing shape of the third example of the present invention.
Figure 10:
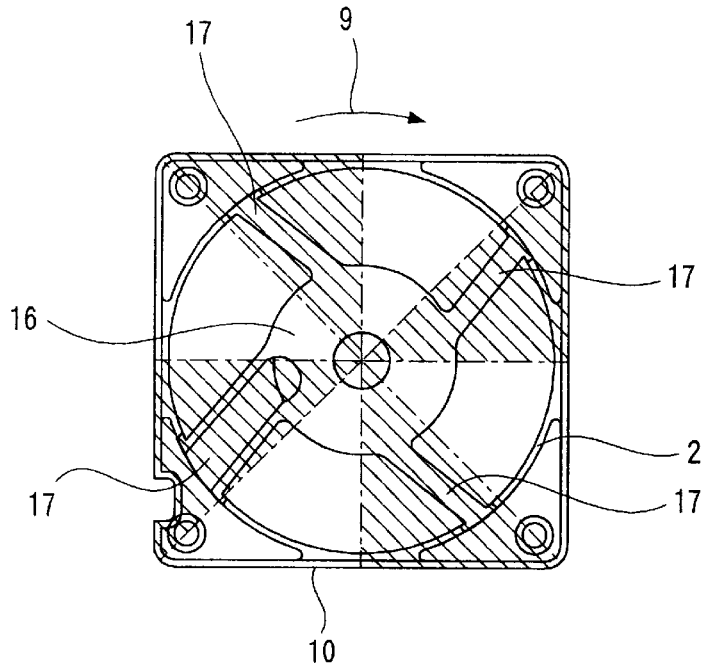
FIG. 10 is an explanatory view showing an optimal connecting position between a spoke and an annular wall in the housing shape of the second example of the present invention.

FIGS. 8 and 9 show an air flow in the vicinity of the air pocket 11 of the housing 10 of the second example (FIG. 5) and the third example (FIG. 6).

The air flow 5 generated by the rotation of the fans 1 has a constant rotational direction component. As shown in FIG. 8, if the joint end of the spoke 17 on the side of the annular wall 2 is deviated toward the rotational direction 9 of the fan 1 from the line connecting the rotational center of the fan 1 to the center of the air pocket 11, more specifically, if the joint end of the spoke 17 to the annular wall 2 is positioned on a downstream side, if the air pocket 11 is divided into an upstream side and the downstream side along the air flow 5 in the rotational direction 9 of the fan, the spokes 17 do not cause much turbulent flow of air around the air pocket 11.

However, as shown in FIG. 9, if the joint end of the spoke 17 on the side of the annular wall 2 is deviated into a direction opposite to the rotational direction 9 of the fan 1 from the line connecting the rotational center of the fan 1 to the center of the air pocket 11, more specifically, if the joint end of the spoke 17 on the side of the annular wall 2 is positioned upstream along the air flow 5 in the rotational direction 9 of the fan, the spokes 17 block the air flow and cause the turbulent flow of air, and the air pocket 11 can not sufficiently exert its effect.

Therefore, if the connection positions of the spokes 17 on the side of the annular wall 2 are positioned on a downstream side, provided that the air pocket 11 is divided into an upstream side and the downstream side along the air flow 5 in the rotational direction of the fan 1, turbulent flow around the air pocket 11 can be reduced, the air pocket 11 can exert its best effect, and the characteristics can be improved.

Next, inclination of the spoke 17 will be described.

In FIGS. 4 and 5, the joint ends of the spokes 17 on the side of the annular wall 2 are approximately the same, but in FIG. 4, the spokes 17*a* and 17*b* are inclined toward the rotational direction 9 of the fan with respect to the radial direction as viewed from the rotational center of the fan 1, and in FIG. 5, the spokes 17*a* and 17*b* are inclined in the opposite direction to the rotational direction 9 with respect to the radial direction as viewed from the rotational center of the fan 1.

Here, various shapes of the fan 1 are possible, but in the case of a common air blower, a sweepforward wing is often used, in which the blade of the fan 1 gradually advances in its rotational direction from its inner periphery side to its outer periphery side. This sweepforward wing type fan 1 has an effect to improve air-blowing characteristics in a state where static pressure is applied to some extent, and allows a noise of the air blower to be reduced and the cooling performance to be improved.

In such a fan shape, if the spokes 17 are inclined in the same direction as the fans 1, as shown in FIG. 4, shapes of rear edges of the spokes 17*a* and the fan 1 are substantially superposed on each other, and whenever the fan 1 passes through the spokes 17*a*, a large pressure fluctuation is caused around the spokes 17*a*, so that the air-blowing performance of the fan 1 is deteriorated and the noise is increased.

On the other hand, if the spokes 17 are inclined in the opposite direction to the fans 1, as shown in FIG. 5, the fan 1 is driven to rotate such that the fan 1 gradually intersect with the spokes 17*a* from the rear edge of the blade tip. Therefore, the interference between the spokes 17*a* and the fan 1 is moderated and the air-blowing performance and the noise are not deteriorated so much.

Thus, if the spokes 17 are inclined in the opposite direction to the rotational direction 9 of the fan 1 with respect to the radial direction as viewed from the rotational center of the fan 1 so that the spokes 17 and the rear edge of the blade tip of the fan 1 gradually intersect with each other, the interference between the spokes 17 and the fan 1 is moderated and it is possible to provide an air blower having excellent air-blowing performance and low noise. Further, since the interference between the spokes 17 and the fan 1 is moderated, even if the performance is the same, the clearance between the spoke 17 and the fan 1 can be reduced, and it is possible to provide a thin air blower which is reduced in size in its axial direction.

From the above reasons, in the spokes 17 of the present invention as shown in FIG. 5, the joint ends of the spokes 17 on the side of the annular wall 2 are positioned on a downstream side, if the air pocket 11 is divided into an upstream side and the downstream side along the air flow 5 in the rotational direction 9 of the fan, and the spokes 17 are formed to incline in the opposite direction to the rotational direction 9 of the fans 1 with respect to the radial direction as viewed from the rotational center of the fans 1, so that the spokes 17 and the rear edge of the blade tip of the fan 1 gradually intersect with each other. As a result, the air pocket 11 can exert its best effect, the characteristics of the air blower can be improved, deterioration of the performance of the air blower can be minimized, and the air blower can be made thinner. Therefore, this design is the optimal.

As a concrete example, characteristics of the air blower using the housing 10 having the shapes shown in FIGS. 4 to 7 will be described below. An outer size of the housing 10 is 60×60×15 mm.

Figure 11:
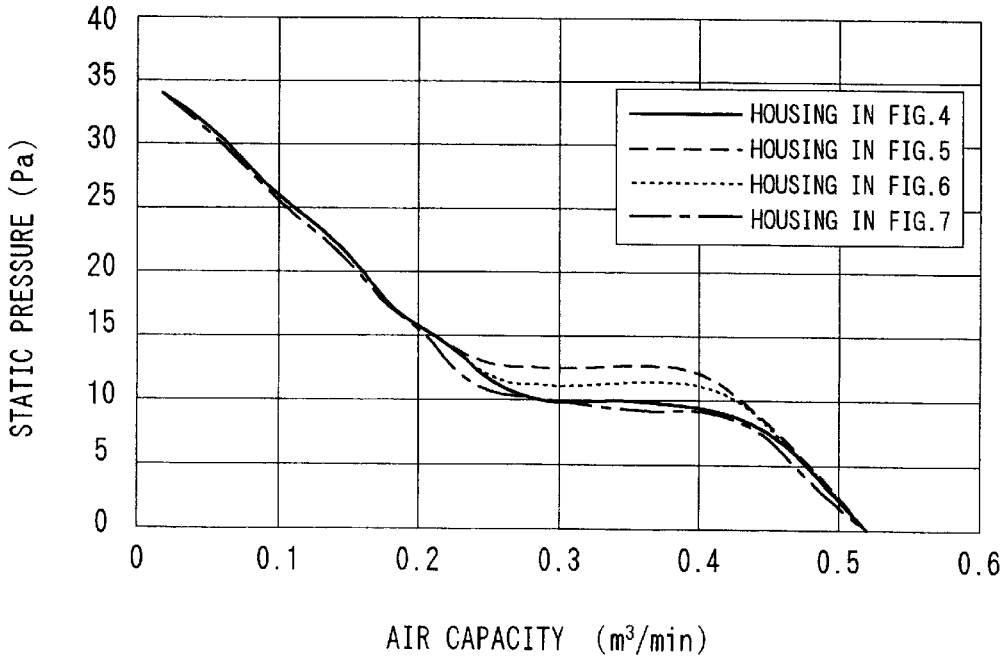
FIG. 11 is a view showing capacity/static pressure characteristics of the air blower in the embodiment of the present invention.

FIG. 11 shows the capacity/static pressure characteristics obtained when only the shape of the housing 10 is changed, and the fan 1, the motor and the like are not changed.

In any of these shapes of the housing 10 shown in FIGS. 4 to 7, the maximum volume of air and maximum static pressure varies little, but characteristics of a medium flow rate region, in which characteristics curves are varied, largely differ, and the housing shapes are excellent in the order of the second example (FIG. 5), the third example (FIG. 6), the first example (FIG. 4) and the fourth example (FIG. 7). This is because the interference between the spokes 17 and the fan 1 largely affects, and if the spokes 17 are inclined in the opposite direction to the rotational direction 9 of the fans 1 such that the spokes 17 and the rear edge of the blade tip of the fan 1 gradually intersect with each other, the interference between the spokes 17 and the fan 1 is moderated.

Figure 12:
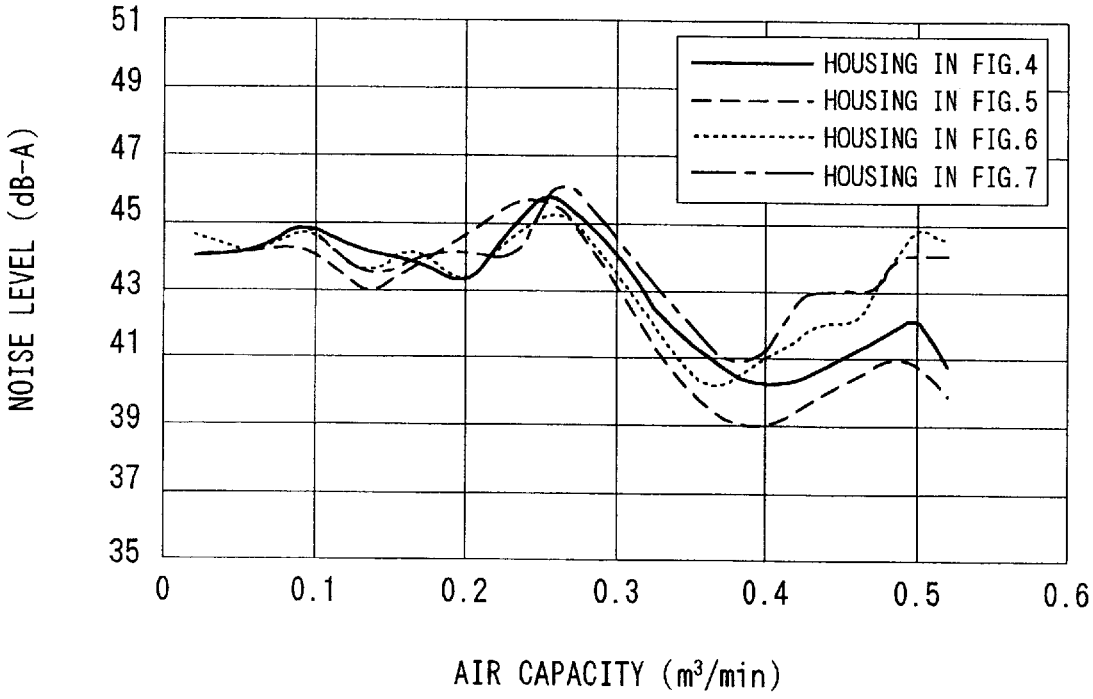
FIG. 12 is a view showing capacity/noise characteristics of the air blower in the embodiment of the present invention.
Figure 13:
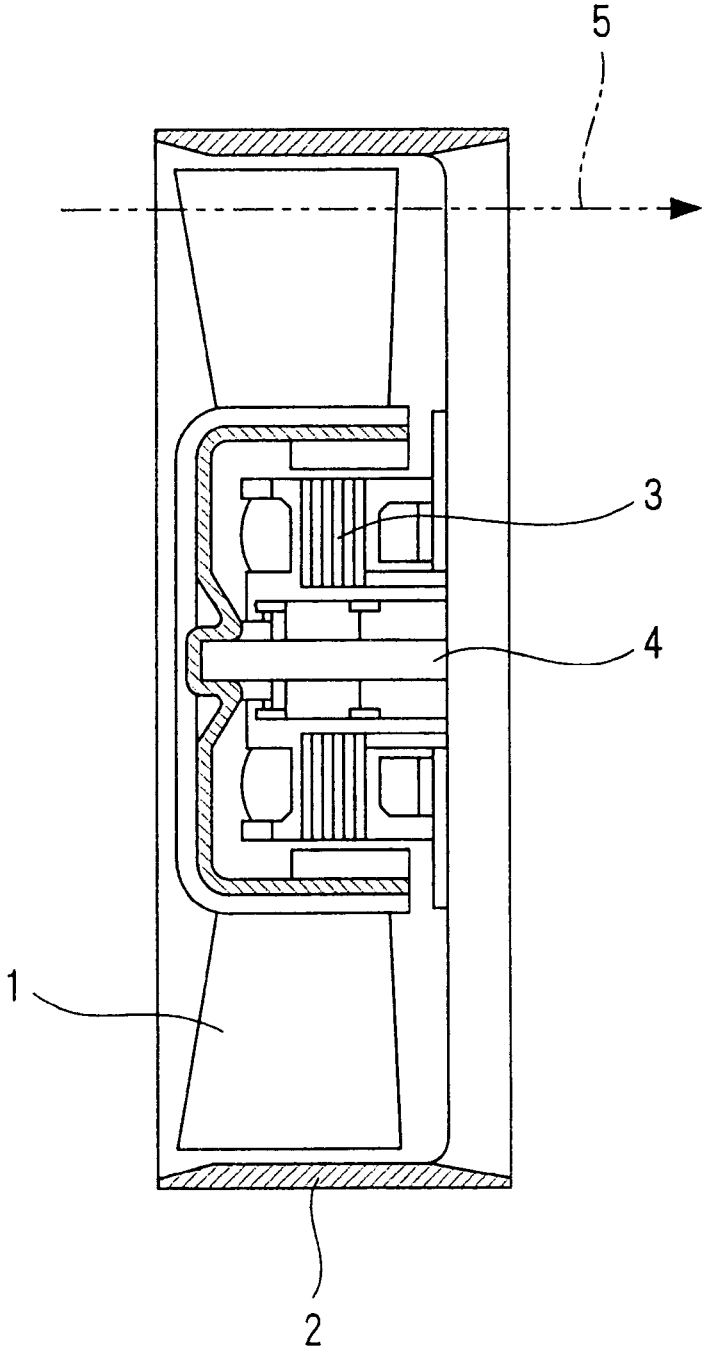
FIG. 13 PRIOR ART
FIG. 13 is a sectional view of a conventional air blower.

FIG. 12 shows capacity/noise characteristics of the air blower in which only the housing shape is changed.

In the capacity/static pressure characteristics shown in FIG. 11, the characteristics of the medium flow rate region is varied, but it can be confirmed that a noise differs in the medium flow rate region to a large flow rate region.

Concerning the noise in the medium flow rate region, the same tendency as that of the capacity/static pressure characteristics can be confirmed. This is because as the capacity/static pressure characteristics are excellent, the fan 1 operates more effectively, and the turbulent flow caused by separation of the air flow 5 is generated a little, and the turbulent flow noise caused by the turbulent flow is small.

On the other hand, in the large flow rate region, a noise of the air blower having the housing 10 of the first and second examples, respectively shown in FIGS. 4 and 5, is small irrespective of the relation of the capacity/static pressure characteristics. This is because influence on the air flow around the air pocket 11 is suppressed to a low level by the spokes 17, and in other words, this indicates that the effect of the air pocket 11 is best exerted in the large flow rate region.

As described above, by devising the shape of the spoke 17, the characteristics of the air blower can largely be improved even if the design of other portions remains the same.

As apparent from the above explanation, according to the air blower of the present invention, the air pocket 11 is provided between the housing body 10*a* and the annular wall 2, the spokes 17 are disposed around the air pocket 11, the joint ends of the spokes 17 on the side of the annular wall 2 are positioned on a downstream side, provided that the air pocket 11 is divided into an upstream side and the downstream side along the air flow 5 in a rotational direction of the fan 1. With this structure, the influence of the spokes 17 can be minimized, and the characteristics of the air blower can be improved.

According to another air blower of the present invention, the air pocket 11 is provided between the housing body 10*a* and the annular wall 2, the spokes 17 are disposed around the air pocket 11, the spokes 17 are placed so as to be inclined in a direction opposite to a rotational direction of the fan 1 with respect to a radial direction as viewed from a rotational center of the fans 1, and the spokes 17 and the fan 1 driven to rotate gradually intersect with each other from rear edge of blade tip of the fan 1, so that the characteristics deterioration caused by interference between the spokes 17 and the fan 1 can be minimized and the air blower can be thinned.

Alternatively, the air pocket 11 is provided between the housing body 10*a* and the outer periphery of the annular wall 2, the spokes 17 are disposed near the air pocket 11, joint ends of the spokes 17 to the annular wall 2 are positioned on a downstream side, provided that the air pocket 11 is divided into an upstream side and the downstream side along the air flow 5 in a rotational direction of the fans 1, the spokes 17 are placed so as to be inclined in a direction opposite to a rotational direction of the fan 1 with respect to a radial direction as viewed from a rotational center of the fan 1, and the spokes 17 and the fan 1 which rotates gradually intersect with each other from rear edges of the blade tips of the fans 1. As a result, a still more preferable air blower can be provided.

Therefore, an OA equipment or AV equipment incorporating the above-described air blower of the invention prevents a noise from being generated, and is small in size and thin in thickness, and can be preferably used in a place such as a separate room which requires a quiet environment, or in a place such as an office with a large number of equipments of the kind.

In above explanation, although the example of the housing body 10*a* having a square outside shape has been described, the shape of the housing is not especially limited to this, and a substantially rectangular shape may be most preferably applied.

What is claimed is:

1. An air blower comprising a fan, a housing body wherein the fan is mounted, an annular wall inside the housing body and spaced from a blade tip of the fan, a boss for attachment to a motor for driving the fan, and spokes connecting the boss and the annular wall, wherein air pockets are located between the housing body and the annular wall, each air pocket having a given volume and opening toward a discharge side of an air flow generated by rotation of the fan, and joint ends of the spokes on the annular wall adjacent the air pockets are respectively positioned on a downstream side of a respective air pocket, wherein each air pocket is divided into an upstream side and said downstream side along the air flow in a rotational direction of the fan.

2. The blower according to claim 1, in combination with an office automation equipment.

3. The blower according to claim 1, in combination with an audio-visual equipment.

4. An air blower comprising a fan, a housing body wherein the fan is mounted, an annular wall inside the housing body and spaced from a blade tip of the fan, a boss for attachment to a motor for driving the fan, and spokes connecting the boss and the annular wall, wherein air pockets are located between the housing body and the annular wall, each air pocket having a given volume and opening toward a discharge side of an air flow generated by rotation of the fan, the spokes on the annular wall located adjacent the air pockets are inclined in a direction opposite to a rotational direction of the fan with respect to a radial direction as viewed from a rotational center of the fan, and the spokes and the rotatative fan gradually intersect with each other from a rear edge of the blade tip of the fan.

5. The blower according to claim 4, in combination with an office automation equipment.

6. The blower according to claim 4, in combination with an audio-visual equipment.

7. An air blower comprising a fan, a housing body wherein the fan is mounted, an annular wall inside the housing body and spaced from a blade tip of the fan, a boss for attachment to a motor for driving the fan, and spokes connecting the boss and the annular wall, wherein air pockets are located between the housing body and the annular wall, each air pocket having a given volume and opening toward a discharge side of an air flow generated by rotation of the fan, joint ends of the spokes on the annular wall adjacent the air pockets are respectively positioned on a downstream side of a respective air pocket, wherein each air pocket is divided into an upstream side and said downstream side along the air flow in a rotational direction of the fan, the spokes are inclined in a direction opposite to a rotational direction of the fan with respect to a radial direction as viewed from a rotational center of the fan, and the spokes and the rotatative fan gradually intersect with each other from a rear edge of the blade tip of the fan.

8. The blower according to claim 7, in combination with an office automation equipment.

9. The blower according to claim 7, in combination with an audio-visual equipment.

* * * * *